United States Patent [19]

Newman

[11] Patent Number: 4,948,141

[45] Date of Patent: Aug. 14, 1990

[54] GOLF GAME FACILITY

[76] Inventor: Vernon H. Newman, 107 Hazel Road, Lakes Entrance, Victoria 3909, Australia

[21] Appl. No.: 378,198

[22] PCT Filed: Dec. 23, 1987

[86] PCT No.: PCT/AU87/00442

§ 371 Date: Jun. 21, 1989

§ 102(e) Date: Jun. 21, 1989

[87] PCT Pub. No.: WO88/04944

PCT Pub. Date: Jul. 14, 1988

[30] Foreign Application Priority Data

Dec. 24, 1986 [AU] Australia ..... PHO9673

[51] Int. Cl.[5] ..... A63B 67/02; A63B 69/36

[52] U.S. Cl. ..... 273/176 FA; 273/181 F; 273/182 A; 273/29 A; 273/184 R; 273/176 G; 272/3

[58] Field of Search ..... 273/176 R, 176 A, 176 B, 273/176 E, 176 F, 182 R, 182 A, 29 A, 184 R, 176 AA, 176 AB, 176 FA, 176 FB, 176 G, 176 H, 176 J, 176 K, 176 L, 185 R

[56] References Cited

U.S. PATENT DOCUMENTS

| | | | |
|---|---|---|---|
| 1,543,401 | 6/1925 | Steinmetz | 273/182 A |
| 1,703,672 | 2/1929 | Housden | 273/182 A |
| 1,788,803 | 1/1931 | MacGeorge | 273/181 R |
| 1,852,948 | 4/1932 | Warren et al. | 273/176 R |
| 2,453,745 | 11/1948 | Dunfee | 273/176 B |
| 3,037,776 | 6/1962 | Younce | 273/182 A |
| 3,129,943 | 4/1964 | McKee | 273/176 A |
| 3,687,457 | 8/1972 | Mason et al. | 273/176 FA |
| 3,948,512 | 4/1976 | Worthington | 272/3 |
| 4,538,814 | 9/1985 | Cunningham | 273/176 F |

FOREIGN PATENT DOCUMENTS

| | | | |
|---|---|---|---|
| 260179 | 5/1963 | Australia | 273/176 A |
| 583529 | 9/1959 | Canada | 273/176 E |

*Primary Examiner*—George J. Marlo

*Attorney, Agent, or Firm*—Fleit, Jacobson, Cohn, Price, Holman & Stern

[57] ABSTRACT

A golf-practice facility having a number of arenas arranged fan-wise or radially from a common amenities or administrative building whereby access is gained to tee-off positions at the near inner ends of the respective arenas. Each arena is an off-ground net cage. At the far end a vertical target is provided to intercept in full flight balls driven from the tee, the height of the target being variable and a range or score indication being made depending on the height of impact on the target. The floor of the cage is inclined and/or valleyed to cause balls dropping to the floor to roll back to the player at the tee-off end.

6 Claims, 3 Drawing Sheets

5
3
6
9
10
14
13
20
8
7
4
4
3
10
7
9
14
13
9

GOLF GAME FACILITY

This invention relates to the playing, in competition or practice, of golf and other games wherein, in normal play, a ball is projected or "shot" such as by hitting it with a club or the like from a "tee", with the object of landing it at or on a desired remote location such as a "green".

Such games often require extensive links ovals and other sequestered tracts of land, usually with careful preparation and care of greens and suchlike areas. Furthermore, the playing of such games may call for considerable movement of the player, usually walking to his ball from the "tee" wherefrom he last hit. Such exercise is by some considered a beneficial, recreational, and even enjoyable aspect of the game. Others, however, see it merely as a time- and energy-wasting incidental to the essence of the game i.e. the striking of the ball into a trajectory which, with due allowance for wind and other factors, will take it to the green and preferably come to rest in the hole.

However there will be times when most players, no matter how skilled at the game or convinced of the benefit of an eighteen-hole walk, will want simply to play or practise their shots, either in a serious or social context.

An object of my invention is to provide a convenient and compact range facility for the playing or practising of golf and suchlike games.

Other objects and advantages will become apparent hereinafter.

Accordingly the present invention provides a range facility for the playing or practising of golf and like games and including a generally openwork arena-defining structure or rig of flexible material which when the facility is in operation provides wall floor and roof rigs for a plurality of elongate arenas or lanes arranged side-by-side each providing at one end a hit-off or tee area and at the other a vertical or substantially vertical target adapted in an elevated position to intercept a ball in its trajectory from the tee end and to indicate the effectiveness of the shot had the trajectory been allowed to continue.

But in order that the invention may be better understood reference will now be made to the accompanying drawings which are to be considered as part of this specification and read herewith. In the drawings.

Figure 1:
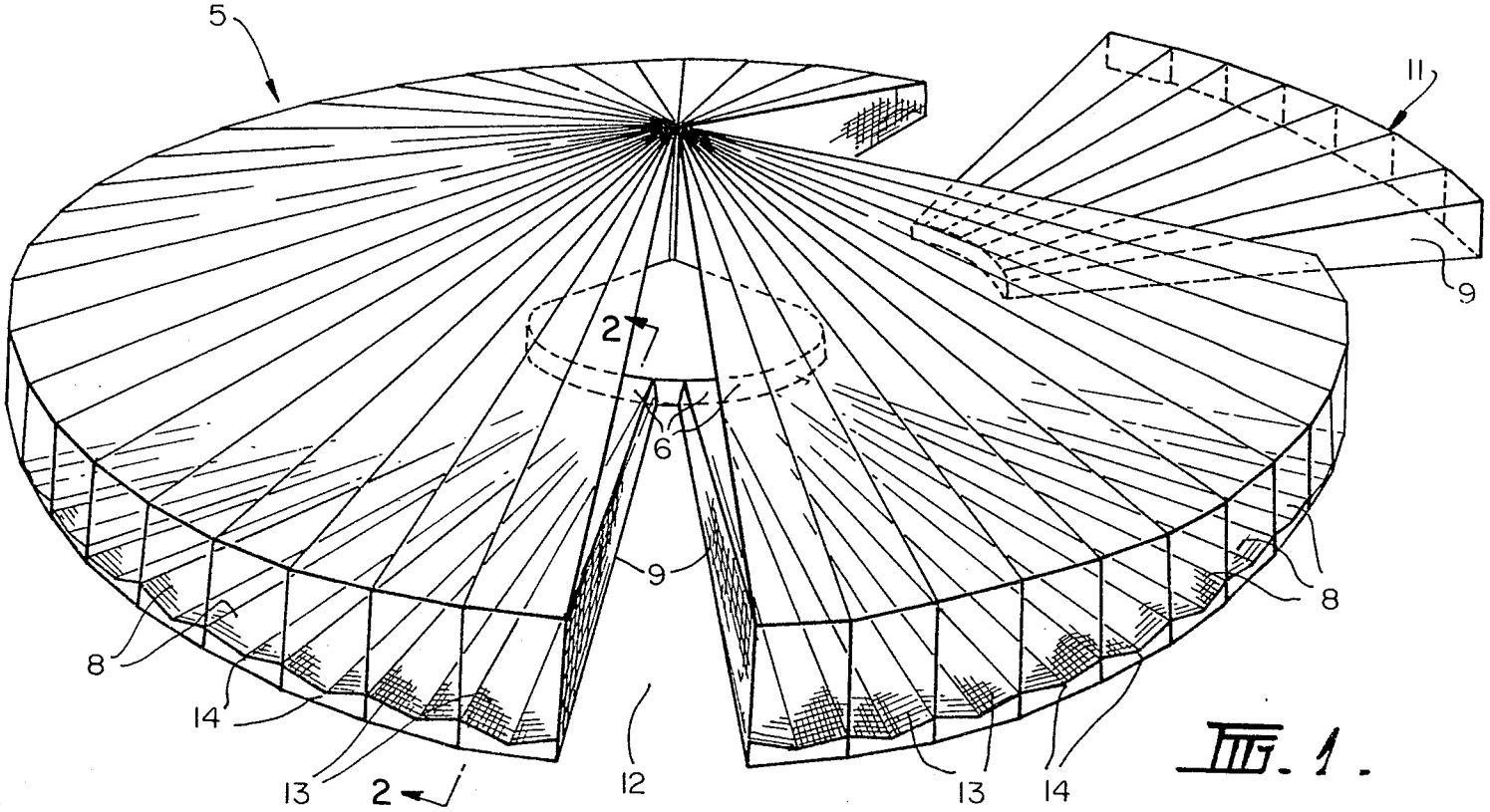
FIG. 1 is a perspective view from above of a golf-practice arena according to a practical embodiment of the invention.
Figures 2, 4:
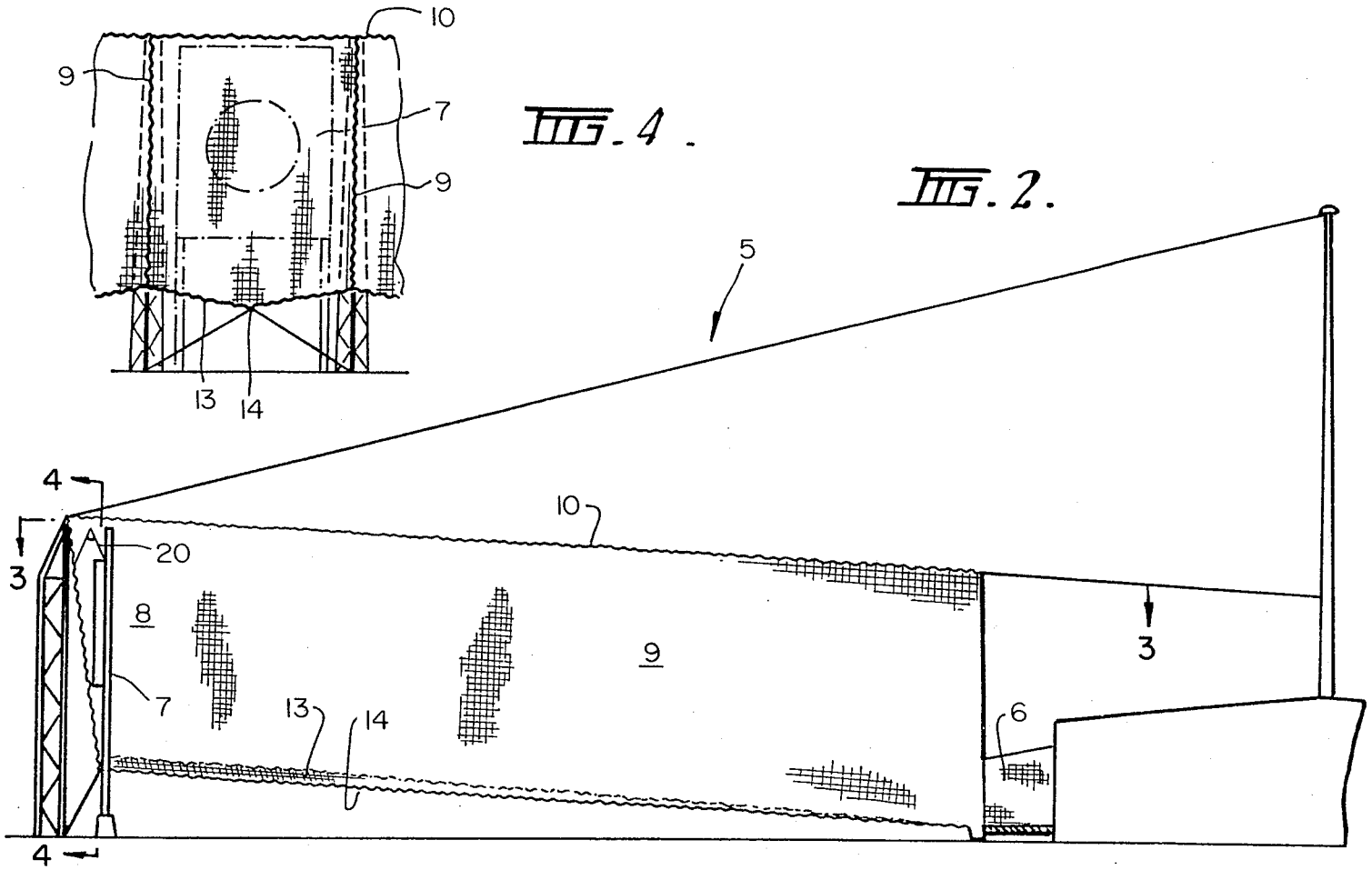
FIG. 2 is a section across line 2—2 in FIG. 1.
FIG. 4 is a section across line 4—4 in FIG. 2.
Figure 3:
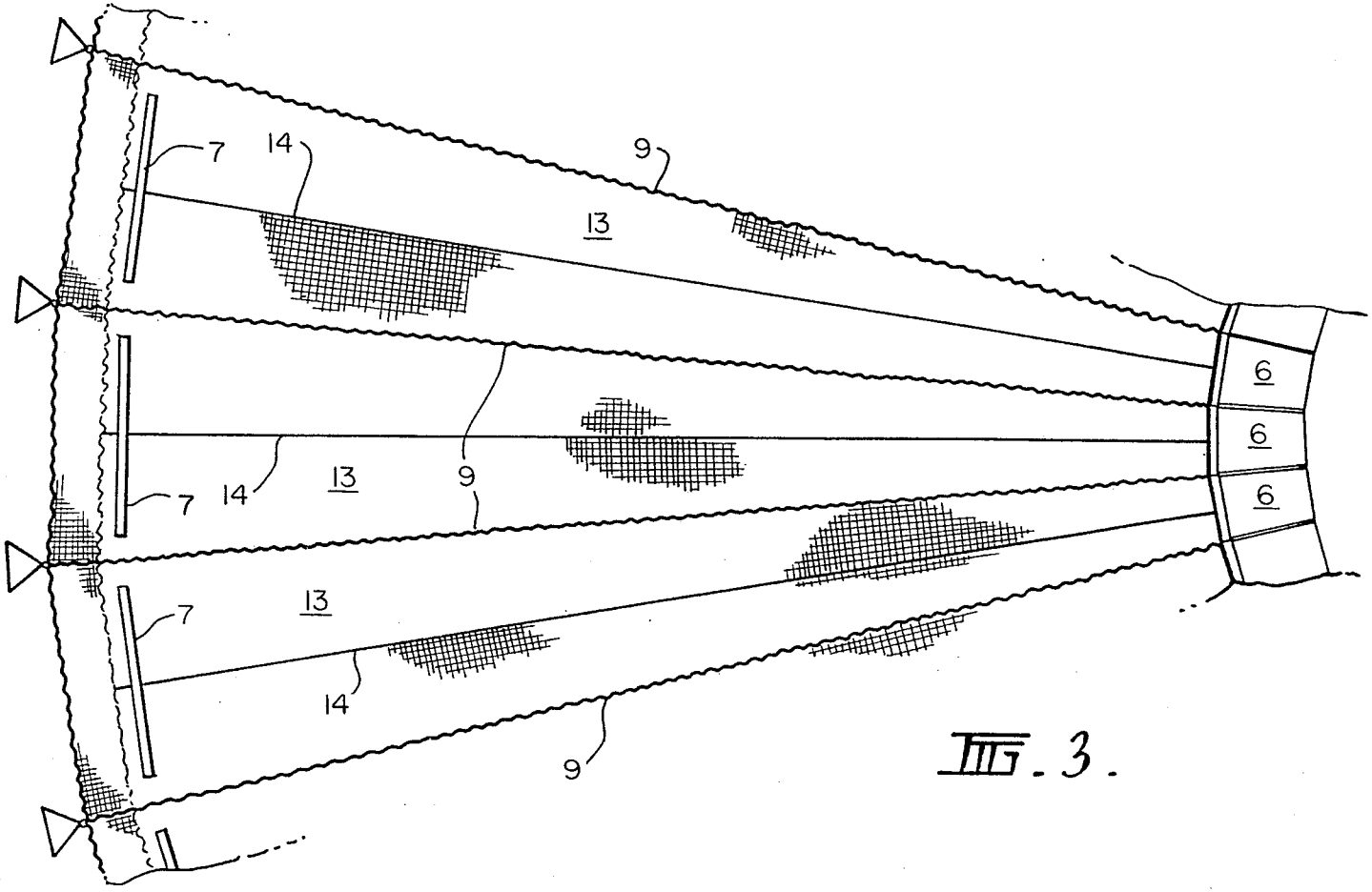
FIG. 3 is a section across line 3—3 in FIG. 2.

Referring to the drawings in more detail, there is shown a golf-practice arena 5 capable of providing a user (hereinafter generally called the "player") with an energy-efficient and time-efficient facility for obtaining practice in accurately hitting a golf ball and for returning the ball to the player for a re-hit, without requiring him to move substantially from the one position. In this form of the invention the arena is a generally confined space or enclosure or substantial enclosure of circular plan with hit-off or "tee" positions 6 near the centre and corresponding targets 7 at or near the circumference of the circle. It will be seen that each arena is a confined space or enclosure or substantial enclosure of elongated rectangular or trapezoidal plan with a hit-off position at or near one ("tee") end and a movable target at or near the other (remote) end. The tee ends 6 of the spaces can be substantially open for ease of access, but the target ends 8, walls 9 and roof 10 may be closed or substantially closed in order to prevent the ball from escaping, and for enabling it to be quickly returned to the player.

Although I describe particularly a circular facility, it will be evident that the invention comprehends part-circular (e.g. sectorial) arrangements—as indicated by 11 in FIG. 1—or a rectangular arrangement wherein the tee and target ends of adjacent lanes are alternated.

A typical arena or lane may be about 40 to 50 metres in length. Obviously such is too short to accommodate the whole length of a typical golf ball trajectory. It is intended that my arena simulate only the first or "hit-off" stage of a "hole", with a suitably marked and/or movable target at which the player aims his shot to hit during the ascending part of the trajectory—although I envisage that a suitably marked and positioned target might be used for the descending part of the trajectory.

The arenas themselves may be defined by an outer and generally openwork rig or structure and an inner central building related hub-wise to the outer rig. The walls 9, roof 10 and target ends 8 of the arena may be made of flexible netting of suitable material and of mesh size suitably small to stop the ball. Netting may be non-abrasive monofilament of a "knotless" type, such as netting which can expand in one direction only. For small arenas and facilities, the nets may be arranged to be furled and unfurled by hand. In larger installations, power assistance will often be required.

Advantageously the walls diverge somewhat from the tee-end towards the remote end of the arena, so that the arena is trapezoidal in plan and wider at the remote end. A "complex" facility or amenities block may include arenas arranged side-by-side with each neighbouring pair having a common wall. As already indicated, trapezoidal-plan arenas may be placed with their tee and target ends alternating so that the overall plan is generally rectangular with a walk-way along each side. Preferably, however, they are arranged like spokes of a wheel as shown in the drawings, with the tee-ends all opening into the central area to which access is given by an entrance passage 12 from outside the wheel "rim".

The floor 13 of each arena or lane is advantageously "valleyed" into a shallow dihedral form symmetrical about a vertical plane through an "apex" line 14 of the dihedral angle. This line may itself be inclined upwardly from the tee to the target end, for ease of returning the ball to the player. Alternatively there may be provided a contrivance, of a kind known per se, for returning balls to a collection area handy to the player.

In a variation of the invention, the floor may be horizontal and/or planar so that with suitable tension it can be used for the practising of tennis and other games wherein a bouncing effect is required to simulate a ground surface rise of the ball, and so obviate the need for a prepared surface such as a tennis court.

In all cases, the floor of the arena may be of suitably tensioned netting, as are the walls, roof and target area of the arena.

The V-floor of the arena may be supported by a metal or like strip along the apex line 14 of the dihedral, giving suitable weight and support along the middle of the floor. Such a strip may also provide means whereby the ball may travel along the sloping path back to the base of the lane i.e. the tee end of the arena, thereby enabling the use of large (and less expensive) mesh for the floor.

The weight of such a strip advantageously maintains a constant tension on the floor nets, allowing the dihedral to become deeper or shallower as the netting is affected by weather conditions. Desirably, also, it tends to stabilize the floor in windy conditions.

As a further feature or alternative the floor instead of being valleyed and/or inclined over its whole length, may comprise a number of sections inclined front-to-rear and each section having at its lowest end a gutter or other ball-collection means.

The target 7 may be a generally rectangular steel frame of white netting (to afford a contrast against black end-wall netting) about 2.5 m wide by 1.5 m high suspended from a rope 20 for raising or lowering, as desired. Vertical side members of the target frame may be fitted with eye-members or tubular guides to receive vertical stabilizer cables. As an alternative to netting, a "hard-back", (e.g. wood or metal) target could be used.

The target may comprise a succession of zones, the outermost having the frame as its outer edge, and the innermost surrounding a central hole in the netting—representing a "hole-in-one jackpot". The zones may be recessed back in succession so that the part of the target facing the player has a generally concave aspect. Vertically beneath each zone may be provided a net bag into which drops a ball which has hit the target anywhere in the relevant zone, and from which the ball may be returned to the player. Associated with each bag may be electrical or other sensing means wired in circuit with a computer or other suitable device for indicating and/or recording a score.

The target may be raised or lowered at the player's will. If desired, means may also be provided for varying the diameter of the central hole.

The roofs may cover the whole of the top of the arenas, but some arenas may be wholly or partially roofless for enabling one to practise high-angle e.g. "pitching" shots.

The walls may be raised by means of a winch fitted with trips which automatically lower them in high winds, and at the same time may provide an automatic stopping system in both fully raised and fully lowered positions. This can be achieved electrically, hydraulically, pneumatically, mechanically, or in combination with manual means. The walls may be controlled so as to raise and lower, also manually if desired. In other words, the walls may be actuated and positioned by any means, desirably with built-in safety factors.

A practical way of achieving this will now be described by reference to a net (to be) supported from the tops of a succession of vertical posts of substantially equal heights. The net or net portions between the posts constitute successive wall portions.

Associated with each post is a lift-line of length substantially equal to the post height i.e. the height of the wall. Each lift-line is attached at a free end thereof to a suitable point on the net. The other end is connected to an elevated main control cable located horizontally at the tops of the poles. where there are pulleys or the like over which the lift-lines pass. This enables the main cable, when pulled horizontally, to pull up the lift-lines and thereby simultaneously raise the net portions to which they are attached. Advantageously, for ease of running, the lift-lines are smoothly spliced into the main cable.

A practical embodiment of cable operating system includes a rotatable drum on which the end portion of the cable is wound, a reversible electric motor drive from the drum, a main switch for the motor and appropriate reduction gears therebetween. Operated in one direction the motor causes the net to be raised; and in the other, to descend, assisted by its own weight. Preferably the gear-box cannot "free-wheel".

Automative switch means may be provided for stopping the motor when the wall netting has been raised and/or lowered to its fullest extent i.e. when the relevant length of cable has been wound onto or off the drum. Such means may include a sensor wheel mounted on the end of a spring-influenced plunger which thrusts the wheel into contact with the cable wound upon the drum. A pin projecting from the plunger is adapted to close stationary switch contacts at the respective limits of its travel. These switches may be so wired as to override the main switch.

The effect of potentially dangerous winds can be counteracted by an emergency device responsive to such extreme tension in the cable as results from the pressure of high winds (e.g. exceeding 30 knots). In general, this tension will substantially exceed the tension required to raise the wall under ordinary conditions. The device may consist essentially of a sheave or pulley mounted on a spring-influenced plunger and located between the cable-operating system at the net wall. The cable passes over the sheave and as the cable tension increases to a predetermined critical extent, depression of the associated plunger trips a reversing or other suitable switch associated with the motor, so as to lower the walls automatically.

The winch may be turned manually in the event of power failure.

In a complex or aggregation of arenas, the walls may conveniently be raised or lowered by attaching cables to a common cable which extends e.g. around the periphery of a circular complex, or along the top of each of the side walls of a "rectangular" complex such that by anchoring one end of the cable and pulling in the other e.g. by means of a winch or windlass, all walls are simultaneously raised or lowered.

The amenities block or complex may be of one or more storeys, as desired, and may be provided with suitable office, toilet, kiosk, library, rest-room and other facilities. The circular type of complex is particularly well adapted to this, because such facilities may all be contained in a central or "hub" area.

For the purposes of this specification terms such as "vertical", "upwardly", "horizontal" and the like are intended to refer simply to the invention or the relevant integer in a position of use and are not, therefore, to be regarded as necessarily limiting.

The claims defining the invention are as follows:

I claim:

1. A golf-practice facility for practicing of driving golf balls to a desired distance, said golf-practice facility comprising:

a plurality of arenas substantially trapezoidal in plan and substantially rectangular in vertical longitudinal section arranged side-by-side, said arenas extending fan-wise from a common access area and each providing a self-sufficient practice or playing area for one or more players, each arena including an off-ground target cage substantially open at an inner or tee-off end, the cage being defined by a floor, a roof, an outer end wall, and side walls diverging from the inner to the outer end, all of furlable, tensionable netting, the floor being inclined to provide a rolling surface for balls falling to the floor at the outer end to return to a player at the tee-off end, the cage including at or near its outer end a target positioned to intercept in full flight a ball driven from the tee-off end, means for raising or lowering the target by a player using the facility according to the range of shot to be practiced, and scoring means responsive to an impact of the ball on the target and to the height of said target to indicate the effectiveness of the shot had the trajectory of the ball been allowed to continue.

2. A facility as claimed in claim 1, wherein the facility is of at least part-circular plan with the arena-defining netting occupying an outer at least part-annular area, the tee ends of the arenas being directly accessible from the common access areas and the target ends being at or near the outer periphery of the netting.

3. A facility as claimed in claim 2 wherein the arena-defining netting is made at least in part of flexible netting material.

4. A facility as claimed in claim 3 including means to furl or retract at least part of the netting to damage by high winds.

5. A facility as claimed in claim 4 wherein said means are adapted to operate automatically in response to tension in the netting or part thereof.

6. A golf-practice facility for the practicing of driving golf balls to a desired distance, said golf-practice facility comprising:

a plurality of arenas substantially trapezoidal in plan and substantially rectangular in vertical longitudinal section arranged side-by-side, said arenas extending fan-wise from a common access area and each providing a self-sufficient practice or playing area for one or more players, each arena including an off-ground target cage substantially open at an inner or tee-off end, the cage being defined by a floor, a roof, an outer end wall, and side walls diverging from the inner to the outer end, all of furlable, tensionable netting, the floor being inclined to provide a rolling surface for balls falling to the floor at the outer end to return to a player at the tee-off end, the cage including at or near its outer end a target positioned to intercept in full flight a ball driven from the tee-off end, means for raising or lowering the target by a player using the facility according to the range of shot to be practiced, and access means for gaining access to said common access area from outside of the facility.

* * * * *